US006087821A

United States Patent [19]

Kojima

[11] Patent Number: 6,087,821

[45] Date of Patent: Jul. 11, 2000

[54] REFERENCE-VOLTAGE GENERATING CIRCUIT

[75] Inventor: Shinichi Kojima, Kanagawa, Japan

[73] Assignee: Ricoh Company, Ltd., Tokyo, Japan

[21] Appl. No.: 09/412,983

[22] Filed: Oct. 6, 1999

[30] Foreign Application Priority Data

Oct. 7, 1998 [JP] Japan ..... 10-285129

[51] Int. Cl.[7] ..... G05F 3/16

[52] U.S. Cl. ..... 323/315

[58] Field of Search ..... 323/313, 315; 327/538, 539, 543; 330/257, 288

[56] References Cited

U.S. PATENT DOCUMENTS

| | | | |
|---|---|---|---|
| 4,399,375 | 8/1983 | Sempel | 323/315 |
| 4,654,578 | 3/1987 | Salerno et al. | 323/313 |
| 5,300,822 | 4/1994 | Sugahara et al. | 323/315 |
| 5,514,948 | 8/1983 | Okazaki | 323/314 |
| 5,948,991 | 3/1996 | Tanoi | 327/333 |

FOREIGN PATENT DOCUMENTS 8-30345 2/1996 Japan .

*Primary Examiner*—Matthew Nguyen
*Attorney, Agent, or Firm*—Dickstein Shapiro Morin & Oshinsky LLP

[57] ABSTRACT

Saturation connection is performed between the gate and source of a depletion-type n-channel MOS transistor, and the depletion-type n-channel MOS transistor generates a first constant current. A current-mirror circuit is connected to the depletion-type n-channel MOS transistor, and mirrors the first constant current. A first enhancement-type n-channel MOS transistor generates a first constant voltage which depends on the first constant current, when receiving the first constant current mirrored by the current-mirror circuit and being activated. A first resistance element is connected between the first enhancement-type n-channel MOS transistor and ground. A second enhancement-type n-channel MOS transistor is connected to the first enhancement-type n-channel MOS transistor and the first resistance element, and controls generation of a second constant current in the first resistance element in accordance with activation of the first enhancement-type n-channel MOS transistor. A second resistance element is connected between a power-supply line and the second enhancement-type n-channel MOS transistor, and generates a second constant voltage which depends on the second constant current.

6 Claims, 3 Drawing Sheets

REFERENCE-VOLTAGE GENERATING CIRCUIT

BACKGROUND OF THE INVENTION

1. Field of the Invention

The present invent ion relates to a semiconductor device, and in particular, to a constant-voltage generating circuit which outputs a constant voltage as a reference voltage.

2. Description of the Prior Art

Japanese Laid-Open Patent Application No. 8-30345 discloses such a type of reference-voltage generating circuit (see FIG. 1), for example.

In the reference-voltage generating circuit in the prior art, shown in FIG. 1, a first transistor which is a depletion-type MOS transistor, a second transistor which is a MOS transistor, the conductivity type of which is the same as that of the first transistor, a source-follower circuit, a first voltage-supply terminal, a second voltage-supply terminal and a voltage-supply terminal for the source-follower circuit are provided. The drain of the first transistor is connected to the first voltage-supply terminal. The gate and source of the first transistor are connected to the drain of the second transistor. The source of the second transistor is connected to the second voltage-supply terminal. The gate of the second transistor is connected to the output terminal of the source-follower circuit or the terminal at which the output voltage of the source-follower circuit is divided. The input terminal of the source-follower circuit is connected to the connection point between the first transistor and the second transistor. The reference voltage can be provided from the output terminal of the source-follower circuit.

Further, in the reference-voltage generating circuit in the prior art, the source-follower circuit comprises a third transistor which is a MOS transistor, the conductivity type of which is the same as that of the first transistor, and a load of the source-follower circuit. The drain of the third transistor is connected to the voltage-supply terminal at which the voltage is supplied to the source-follower circuit. The gate of the third transistor is used as the input terminal of the source-follower circuit. A first terminal of the load of the source-follower circuit is connected to the source of the third transistor. A second terminal of the load of the source-follower circuit is connected to the other voltage-supply terminal at which the other voltage is supplied to the source-follower circuit. The connection point between the third transistor and the load of the source-follower circuit is used as the output terminal of the source-follower circuit.

Thereby, it is possible to provide the reference-voltage generating circuit with less consumed power, an adjustable temperature coefficient of the output voltage, a small output impedance, an output which can be provided externally of a semiconductor integrated circuit, and an output current can be provided. Further, it is possible to adjust the output voltage of the reference-voltage generating circuit, although such adjustment is not possible in the further prior art. Further, by using a sixth transistor (which is turned on and turned off externally of the reference-voltage generating circuit) in the load of the source-follower circuit, it is possible to provide the reference-voltage generating circuit in which it is possible to switch the current consumption and the output impedance when the state is changed between an operation state and a stand-by state.

Furthermore, the reference-voltage generating circuit in the prior art may be modified as follows: A plurality of source-follower circuits are additionally provided, all of the inputs of the thus-added source-follower circuits are connected to the connection point between the first transistor and the second transistor, and the outputs of the thus-added source-follower circuits are used as the reference-voltage output terminals separately.

Thereby, it is possible to provide a plurality of reference-voltage output terminals having no mutual interference, easily, and, also, without increasing the consumed current nor increasing the chip area, in comparison to the further prior art.

Further, the reference-voltage generating circuit in the prior art may be modified as follows: The source-follower circuit comprises the third transistor which is the MOS transistor, the conductivity type of which is the same as that of the first transistor, a source resistor and the load of the source-follower circuit. The drain of the third transistor is connected to the voltage-supply terminal at which the voltage is supplied to the source-follower circuit. The gate of the third transistor is used as the input terminal of the source-follower circuit. A first terminal of the source resistor is connected to the source of the third transistor. A second terminal of the source resistor is connected to the first terminal of the load of the source-follower circuit. The second terminal of the load of the source-follower circuit is connected to the other voltage-supply terminal at which the other voltage is supplied to the source-follower circuit. The connection point between the source resistor and the load of the source-follower circuit is used as the output terminal of the source-follower circuit.

Thereby, it is possible to provide the reference-voltage generating circuit in which it is possible to perform a stable operation using an input voltage higher than that of the further prior art.

Further, the reference-voltage generating circuit in the related art may be modified as follows: A seventh transistor, which is a MOS transistor, the conductivity type of which is different from that of the first transistor, or an eighth transistor, which is a MOS transistor, the conductivity type of which is the same as that of the first transistor, or both the seventh transistor and the eighth transistor are added to the source-follower circuit which comprises the third transistor, which is a MOS transistor, the conductivity type of which is the same as that of the first transistor, and the load of the source-follower circuit. When the seventh transistor is added, the connection between the voltage-supply terminal at which the voltage is supplied to the source-follower circuit and the third transistor is separated, the source of the seventh transistor is connected to the voltage-supply terminal at which the voltage is supplied to the source-follower circuit, and the drain of the seventh transistor and the gate of the seventh transistor are connected to the drain of the third transistor. When the eighth transistor is added, the connection between the other voltage-supply terminal at which the other voltage is supplied to the source-follower circuit and the load of the source-follower circuit is separated, the source of the eighth transistor is connected to the other voltage-supply terminal at which the other voltage is supplied to the source-follower circuit, and the drain of the eighth transistor and the gate of the eighth transistor are connected to the second terminal of the load of the source-follower circuit. The connection point between the drain of the third transistor and the load of the source-follower circuit is used as the output terminal of the source-follower circuit. The gate of the seventh transistor is connected to the drain of the seventh transistor. The output voltage to a constant-current circuit can be provided from the connection point between the third transistor and the seventh transistor, and, also, the other output voltage to the constant-current circuit can be provided from the connection point between the load of the source-follower circuit and the eighth transistor. The output voltages to the constant-current circuit are supplied to the gates of MOS transistors included in the constant-current circuit.

Thereby, it is possible to provide the reference-voltage generating circuit in which it is possible to freely adjust the temperature coefficient, and, also, it is possible to freely adjust the output current of the constant-current circuit.

However, in these reference-voltage generating circuits in the prior art, the reference output voltage is generated using the sum of the threshold voltage Vth of the first transistor and the threshold voltage Vth of the second transistor. Therefore, it is difficult to generate a reference output voltage close to the power-source voltage.

For example, it is difficult to generate a reference output voltage which is slightly lower than the power-source voltage, such as:

power-source voltage−0.1 (*V*)

for example.

SUMMARY OF THE INVENTION

An object of the present invention is to solve such a problem in the prior art, and, in particular, an object of the present invention is to provide a reference-voltage generating circuit which can generate a reference output voltage slightly lower than a power-source voltage, such as:

power-source voltage−0.1 (*V*)

for example.

Further, another object of the present invention is to provide a reference-voltage generating circuit which enables such a reference output voltage to have a flat temperature characteristic.

A reference-voltage generating circuit, according to the present invention, comprises:

a depletion-type n-channel MOS transistor, the gate of the depletion-type n-channel MOS transistor being connected to its source and the bias of the depletion-type n-channel MOS transistor being set to such a condition that the depletion-type n-channel MOS transistor operates in the saturation region so as to act as a constant-current source and generate a first constant current;

a first enhancement-type p-channel MOS transistor, the gate and drain of the first enhancement-type p-channel MOS transistor being connected to one another, the first enhancement-type p-channel MOS transistor being connected between a power-supply line and the depletion-type n-channel MOS transistor;

a second enhancement-type p-channel MOS transistor, connected to the power-supply line to which the first enhancement-type p-channel MOS transistor is also connected, constituting a current-mirror circuit together with the first enhancement-type p-channel MOS transistor and mirroring the first constant current;

a first enhancement-type n-channel MOS transistor, connected between the drain of the second enhancement-type p-channel MOS transistor and ground;

a first resistance element, connected between the gate of the first enhancement-type n-channel MOS transistor and the ground;

a second enhancement-type n-channel MOS transistor, constituting a source-follower circuit together with the first resistance element, and controlling generation of a second constant current in the first resistance element in accordance with activation of the first enhancement-type n-channel MOS transistor;

a first reference-voltage output terminal, connected to the connection point between the first resistance element and the source of the second enhancement-type n-channel MOS transistor, for outputting a first reference voltage;

a second resistance element, connected between the power-supply line and the drain of the second enhancement-type n-channel MOS transistor; and a second reference-voltage output terminal, connected to the connection point between the second resistance element and the drain of the second enhancement-type n-channel MOS transistor, for outputting a second reference voltage.

In this arrangement, the gate of the depletion-type n-channel MOS transistor is connected to its source and the bias of the depletion-type n-channel MOS transistor is set to such a condition that the depletion-type n-channel MOS transistor operates in the saturation region so as to act as the constant-current source and generate the first constant current. In response thereto, the first enhancement-type p-channel MOS transistor, which is connected between the power-supply line and the depletion-type n-channel MOS transistor, is in the condition in which the gate and drain thereof are connected to one another, and supplies the first constant current to the depletion-type n-channel MOS transistor. In response thereto, the second enhancement-type p-channel MOS transistor, which is in the condition in which this MOS transistor constitutes the current-mirror circuit together with the first enhancement-type p-channel MOS transistor which is connected to the power-supply line to which the second enhancement-type p-channel MOS transistor is also connected, performs mirroring of the above-mentioned first constant current. In response thereto, the first enhancement-type n-channel MOS transistor, which is connected between the drain of the second enhancement-type p-channel MOS transistor and the ground, receives the first constant current, which is supplied thereto as a result of the mirroring being performed by the current mirror circuit, and is activated. At this time, the first enhancement-type n-channel MOS transistor generates a first constant voltage which depends on the first constant current, which is supplied thereto as a result of the mirroring being performed by the current mirror circuit. Thereby, the second enhancement-type n-channel MOS transistor, which constitutes the source-follower circuit together with the first resistance element, is activated in accordance with the above-mentioned activation of the first enhancement-type n-channel MOS transistor, and controls generation of the second constant current in the above-mentioned first resistance element. Further, as a result of the second constant current flowing through the second resistance element, connected between the power-supply line and the drain of the second enhancement-type n-channel MOS transistor, it is possible to generate the reference output voltage slightly lower than the power-supply-line voltage, such as:

(power-supply-line voltage)−0.1 (*V*)

The first and second resistance elements may have the same temperature coefficient, and each of the first and second resistance elements may comprise a resistor at least at a portion thereof, the resistance value of which resistor can be set to a desired value through trimming.

In this arrangement, as a result of making the temperature coefficient of the first resistance element and the temperature coefficient of the second resistance element identical to one another, it is possible for the reference output voltage to have a flat temperature characteristic. Further, each of the first and second resistance elements may comprise a resistor at least at a portion thereof, the resistance value of which resistor can be set to a desired value through trimming. Thereby, at the timing of a laser trimming process after these resistance elements are formed in a semiconductor chip together with the semiconductor devices through the semiconductor process, it is possible to perform fine adjustment of the resistance values of the first and second resistance elements. As a result, it is possible to generate the high-accuracy reference output voltage which is slightly lower than the power-supply-line voltage.

The gate dimensions of the depletion-type n-channel MOS transistor and the gate dimensions of the first enhancement-type n-channel MOS transistor may be set so that the first reference voltage is equal to the sum of the threshold voltage of the depletion-type n-channel MOS transistor and the threshold voltage of the first enhancement-type n-channel MOS transistor.

In this arrangement, because it is possible to determine the reference output voltage based on the threshold voltages which have good temperature characteristics, it is possible to enable the reference output voltage to have a flat temperature characteristic.

A reference-voltage generating circuit, according to another aspect of the present invention comprises:

a depletion-type n-channel MOS transistor, the gate of the depletion-type n-channel MOS transistor being connected to its source and the bias of the depletion-type n-channel MOS transistor being set to such a condition that the depletion-type n-channel MOS transistor operates in the saturation region so as to generate a first constant current;

a current-mirror circuit, connected to the depletion-type n-channel MOS transistor, and mirroring the first constant current;

a first enhancement-type n-channel MOS transistor, generating a first constant voltage which depends on the first constant current, when receiving the first constant current mirrored by the current-mirror circuit and being activated, the first constant voltage being outputted as a first reference voltage;

a first resistance element, connected between the first enhancement-type n-channel MOS transistor and ground;

a second enhancement-type n-channel MOS transistor, connected to the first enhancement-type n-channel MOS transistor and the first resistance element, and controlling generation of a second constant current in the first resistance element in accordance with activation of the first enhancement-type n-channel MOS transistor; and a second resistance element, connected between a power-supply line and the second enhancement-type n-channel MOS transistor, and generating a second constant voltage which depends on the second constant current, a voltage at the point between the second resistance element and the second enhancement-type n-channel MOS transistor being outputted as a second reference voltage.

Other objects and further features of the present invention will become more apparent from the following detailed description when read in conjunction with the accompanying drawings.

DETAILED DESCRIPTION OF THE PREFERRED EMBODIMENTS

A first embodiment of the present invention will now be described.

Figure 1:
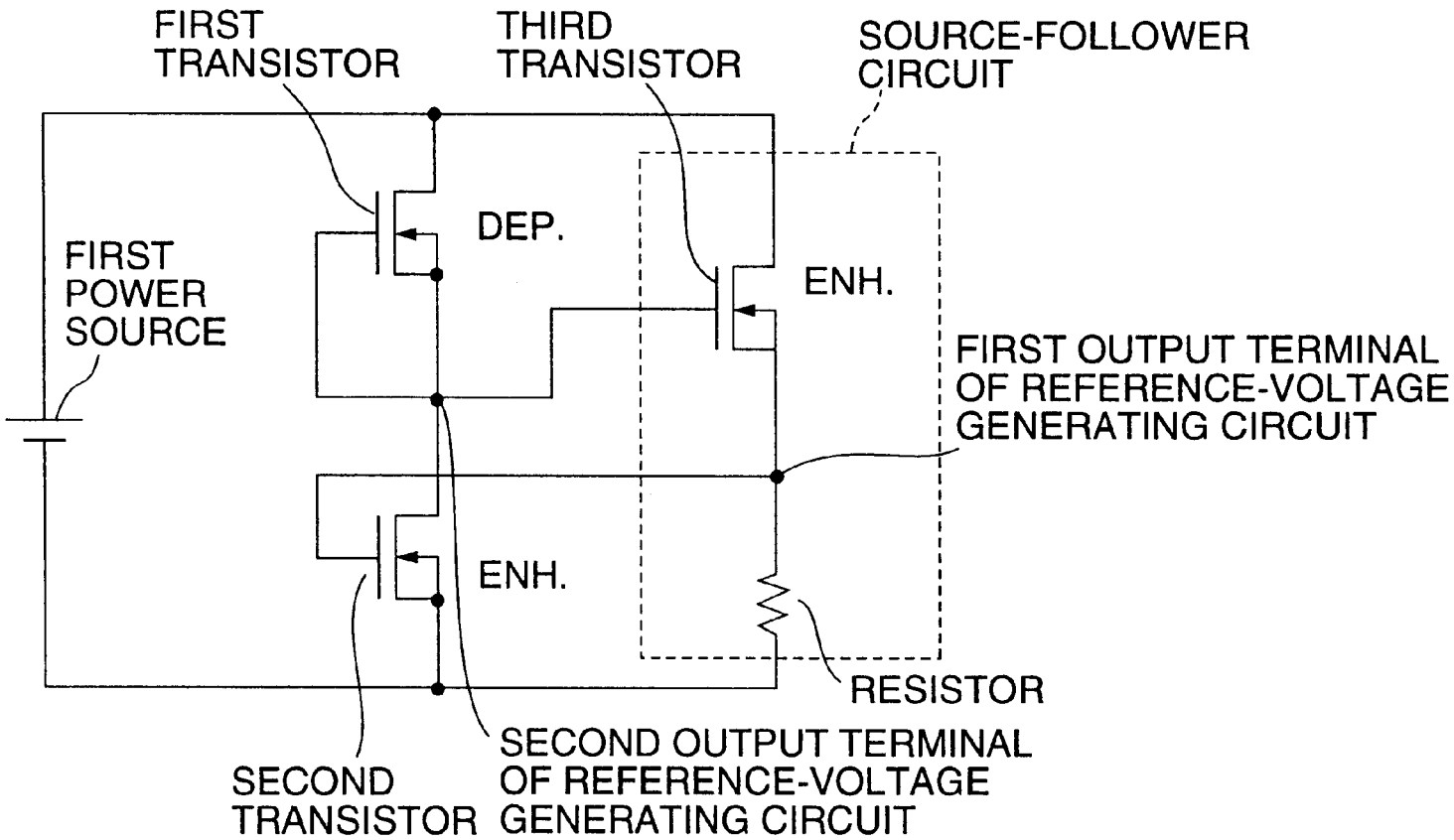
FIG. 1 PRIOR ART
FIG. 1 is a circuit diagram for illustrating a reference-voltage generating circuit in the prior art.
Figure 2:
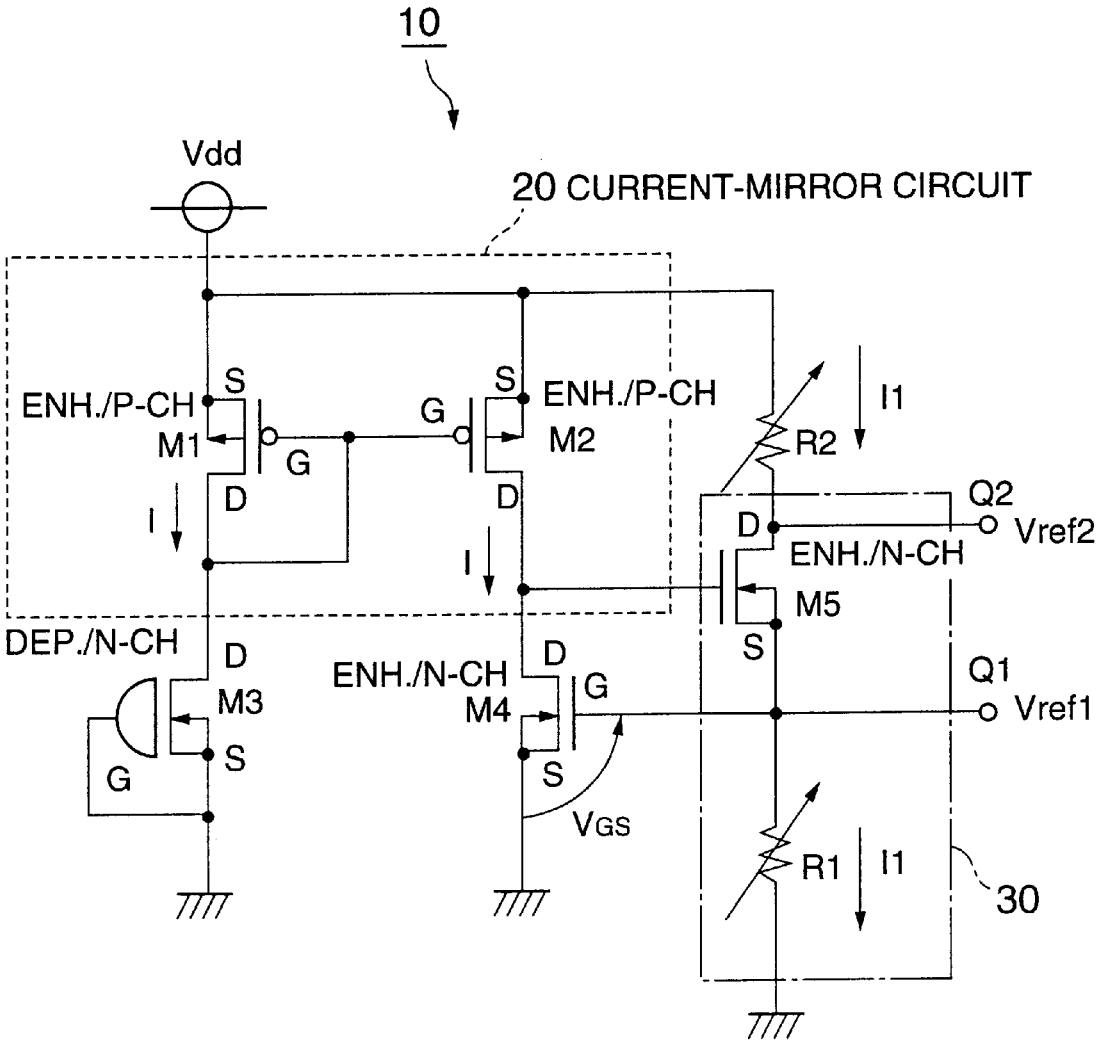
FIG. 2 is a circuit diagram for illustrating a first embodiment of a reference-voltage generating circuit according to the present invention.

FIG. 2 is a circuit diagram for illustrating the first embodiment of a reference-voltage generating circuit according to the present invention. A reference-voltage generating circuit 10 in the first embodiment is a constant-voltage circuit which outputs a constant voltage as a reference voltage, and, in particular, works well as a reference-voltage source integrated in a constant-voltage power-source IC such as a voltage regulator, a voltage detector, a DC—DC converter, or the like. The reference-voltage generating circuit 10, shown in FIG. 2, includes a first enhancement-type p-channel (ENH./P-CH) MOS transistor M1, a second enhancement-type p-channel (ENH./P-CH) MOS transistor M2, a depletion-type n-channel (DEP./N-CH) MOS transistor M3, a first enhancement-type n-channel (ENH./N-CH) MOS transistor M4, a second enhancement-type n-channel (ENH./N-CH) MOS transistor M5, a first resistance element R1, a second resistance element R2, a first reference-voltage output terminal Q1 and a second reference-voltage output terminal Q2.

The gate G of the depletion-type n-channel MOS transistor M3 is connected to its source S and the bias of the depletion-type n-channel MOS transistor M3 is set to such a condition that the depletion-type n-channel MOS transistor M3 operates in the saturation region so as to function as a constant-current source and have a function of generating a first constant current I.

The gate G and drain D of the first enhancement-type p-channel MOS transistor M1 are connected with one another, and the MOS transistor M1 is connected between a power-supply line through which operating power is supplied to the reference-voltage generating circuit 10 and the depletion-type n-channel MOS transistor M3. (The voltage of the above-mentioned power-supply line is Vdd, and this power-supply line will be referred to as an operating power-supply line.)

The second enhancement-type p-channel MOS transistor M2 and the first enhancement-type p-channel MOS transistor M1 are connected in common to the operating power-supply line, and, together, constitute a current-mirror circuit 20. Further, the second enhancement-type p-channel MOS transistor M2 has a function of mirroring the first constant current I, and supplying the current (that is, I) the same as the first constant current I to the first enhancement-type n-channel MOS transistor M4.

The first enhancement-type n-channel MOS transistor M4 is connected between the drain D of the second enhancement-type p-channel MOS transistor M2 and the ground GND, in series with the MOS transistor M2. The MOS transistor M4 has a function of generating a first constant voltage $V_{GS}$ which depends on the first constant current I, which is supplied thereto as a result of mirroring being performed by the current-mirror circuit 20, when the MOS transistor M4 receives the first constant current I, which is supplied thereto as a result of mirroring being performed by the current-mirror circuit 20, and is activated (that is, a voltage higher than the gate threshold voltage is supplied to the gate thereof, and the amount of the drain current flowing through the channel is controlled by the gate voltage).

Specifically, the first constant current I in the first enhancement-type n-channel MOS transistor M4 is expressed by the following equation:

$$I=(1/2)\cdot K_N\cdot(W2/L2)\cdot(V_{GS}-Vthn)^2$$

therefore, $$V_{GS}=\{I/[(1/2)\cdot K_N\cdot(W2/L2)]\}^{0.5}+Vthn$$

where $K_N$ represents a constant of proportion, W2 represents the gate width (the unit of which is $\mu$m) of the first enhancement-type n-channel MOS transistor M4, L2 represents the gate length (the unit of which is $\mu$m) of the first enhancement-type n-channel MOS transistor M4 and Vthn represents the gate threshold voltage of the first enhancement-type n-channel MOS transistor M4.

Because $K_N$ is the constant of proportion, and W2, L2 and Vthn are process constants which are determined at the time of manufacturing of the device, the value of the first constant voltage $V_{GS}$ is proportional to the value of the first constant current I.

Further, in the first embodiment, the gate dimensions (gate length L1 and gate width W1) of the depletion-type n-channel MOS transistor M3 and the gate dimensions (gate length L2 and gate width W2) of the first enhancement-type n-channel MOS transistor M4 are set such that the first constant voltage $V_{GS}$ is the sum of the threshold voltage Vthd of the depletion-type n-channel MOS transistor M3 and the threshold voltage Vthn of the first enhancement-type n-channel MOS transistor M4.

Specifically, the first constant current I in the depletion-type n-channel MOS transistor M3 is expressed by the following equation:

$$I=(1/2)\cdot K_D\cdot(W1/L1)\cdot(Vthd)^2$$

Further, as mentioned above, the first constant current I in the first enhancement-type n-channel MOS transistor M4 is expressed by the following equation:

$$I=(1/2)\cdot K_N\cdot(W2/L2)\cdot(V_{GS}-Vthn)^2$$

Therefore, from these two equations, the first constant voltage $V_{GS}$ is expressed by the following equation:

$$V_{GS}=\{(K_D/K_N)\cdot(W1/L1)\cdot(L2/W2)\cdot(Vthd)^2\}^{0.5}+Vthn$$

where $K_D$ represents a constant of proportion, W1 represents the gate width (the unit of which is $\mu$m) of the depletion-type n-channel MOS transistor M3, L1 represents the gate length (the unit of which is $\mu$m) of the depletion-type n-channel MOS transistor M3 and Vthd represents the gate threshold voltage of the depletion-type n-channel MOS transistor M3.

As can be seen from the above equation, it is possible to set the first reference voltage $V_{ref1}$ (=$V_{GS}$), which is the electric potential of the terminal (which is one connected to the MOS transistor M4) of the first resistance element R1, approximately to the sum (=|Vthd|+Vthn) of the threshold voltage |Vthd| and the threshold voltage Vthn, by selecting the gate dimensions (gate length L1 and gate width W1) of the depletion-type n-channel MOS transistor M3 (the threshold voltage: Vthd) and the gate dimensions (gate length L2 and gate width W2) of the first enhancement-type n-channel MOS transistor M4 (the threshold voltage: Vthn).

Thereby, it is possible to determine the reference output voltage based on the threshold voltages Vthn and Vthd which have good temperature characteristics, and, as a result, it is possible to enable the reference output voltage to have a flat temperature characteristic.

The second enhancement-type n-channel MOS transistor M5 is connected to the first resistance element R1 so as to form a source-follower circuit 30, and has a function of being activated in accordance with activation of the first enhancement-type n-channel MOS transistor M4 and controlling generation of a second constant current I1 in the first resistance element R1.

The first reference-voltage output terminal Q1 is connected to the connection point between the first resistance element R1 and the source S of the second enhancement-type n-channel MOS transistor M5, and is a terminal for externally outputting the first constant voltage $V_{GS}$ as the first reference voltage $V_{ref1}$.

The second reference-voltage output terminal Q2 is connected to the connection point between the second resistance element R2 and the drain D of the second enhancement-type n-channel MOS transistor M5, and is a terminal for externally outputting the constant voltage (=(operating-power-supply-line voltage Vdd)−R2×I1), generated as a result of a second constant voltage (=R2×I1) being subtracted from the operating-power-supply-line voltage Vdd, as the second reference voltage $V_{ref2}$.

At this time, the second constant current I1 is expressed by the following equation:

$$I1=V_{ref1}/R1$$

At this time, the second reference voltage $V_{ref2}$ at the second reference voltage output terminal Q2 is expressed by the following equation:

$$V_{ref}=(\text{operating-power-supply-line voltage } Vdd)-I1\cdot R2$$

From these two equations, $$V_{ref2}=(\text{operating-power-supply-line voltage } Vdd)-(R2/R1)\cdot V_{ref1}$$

In consideration of being integrated in the an IC together with devices formed from polycrystal silicon, the first resistance element R1 is formed using the same polycrystal silicon as that of the devices, at the same time, in the process in which the devices are formed. The first resistance element R1 has a function of receiving the first constant voltage $V_{GS}$ and generating the second constant current I1 which depends on the first constant voltage $V_{GS}$. The first resistance element R1 comprises a resistor at least at a portion thereof, the resistance value of which resistor can be set to a desired value through trimming.

Also, in consideration of being integrated in the IC together with the devices formed from the polycrystal silicon, the second resistance element R2 is formed using the same polycrystal silicon as that of the devices, at the same time, in the process in which the devices are formed. The second resistance element R2 is connected between the operating power-supply line and the source-follower circuit 30, in series with the first resistance element R1, and has a function of receiving the second constant current I1 from the source-follower circuit 30 and generating the second constant voltage which depends on the second constant current I1. The second resistance element R2 comprises a resistor at least at a portion thereof, the resistance value of which resistor can be set to a desired value through trimming.

In the first embodiment, the first resistance element R1 and second resistance element R2 are formed using the same polycrystal silicon, at the same time, in the process in which the devices are formed. Thereby, it is possible to make the temperature coefficient of the first resistance element R1 and the temperature coefficient of the second resistance element R2 identical to one another.

As a result of making the temperature coefficient of the first resistance element R1 and the temperature coefficient of the second resistance element R2 identical to one another, it is possible for the reference output voltage to have a flat temperature characteristic.

Specifically, assuming that the first resistance element R1 has the temperature coefficient and the second resistance element R2 has the same temperature coefficient , the resistance values R1 and R2 of the first and second resistance elements R1 and R2 are expressed as follows:

$$R1=(1+\Delta t\cdot)\cdot R1ref$$

$$R2=(1+\Delta t\cdot)\cdot R2ref$$

where R1ref represents the resistance value (the unit of which is Ω of the first resistance element R1 at a reference temperature (for example, a room temperature 23° C.), R2ref represents the resistance value (the unit of which is Ω) of the second resistance element R2 at the reference temperature, and Δt represents a temperature change amount (the unit of which is °C.).

From combining the above equations, $$V_{ref2}=(\text{operating-power-supply-line voltage } Vdd)-(R2ref/R1ref)\cdot V_{ref1}$$

Thus, the reference output voltage $V_{ref2}$ does not depend on the temperature coefficient of the resistance elements R1 and R2.

That is, when designing is performed such that no change occurs in the first reference voltage $V_{ref1}$ ($=V_{GS}$) due to temperature changes Δt, no change occurs in the second reference voltage $V_{ref2}$ due to the temperature changes Δt. Further, by setting the resistance value of the second resistance element R2 to an appropriate one, through trimming or the like, it is possible to set the second reference voltage $V_{ref2}$ arbitrarily on the order of $$(\text{operating-power-supply-line voltage } Vdd)-0.1\ (V)$$

Thus, in the first embodiment, the gate G of the depletion-type n-channel MOS transistor M3 is connected to its source S and the bias of the MOS transistor M3 is set to such a condition that the depletion-type n-channel MOS transistor M3 operates in the saturation region so as to act as the constant-current source and generate the first constant current I. In response thereto, the first enhancement-type p-channel MOS transistor M1, which is connected between the operation power-supply line and the depletion-type n-channel MOS transistor M3, is in the condition in which the gate G and drain D thereof are connected to one another, and supplies the first constant current I to the depletion-type n-channel MOS transistor M3. In response thereto, the second enhancement-type p-channel MOS transistor M2, which is in the condition in which the MOS transistor M2 constitutes the current-mirror circuit 20 together with the first enhancement-type p-channel MOS transistor M1 which is connected to the operating power-supply line to which the MOS transistor M2 is also connected, performs mirroring of the above-mentioned first constant current I. In response thereto, the first enhancement-type n-channel MOS transistor M4, which is connected between the drain D of the second enhancement-type p-channel MOS transistor M2 and the ground GND, receives the first constant current I, which is supplied thereto as a result of the mirroring being performed by the current mirror circuit 20, and is activated. At this time, the MOS transistor M4 generates the first constant voltage $V_{GS}$ which depends on the first constant current I, which is supplied thereto as a result of the mirroring being performed by the current mirror circuit 20. Thereby, the second enhancement-type n-channel MOS transistor M5, which constitutes the source-follower circuit 30 together with the first resistance element R1, is activated in accordance with the above-mentioned activation of the first enhancement-type n-channel MOS transistor M4, and controls generation of the second constant current I1 in the above-mentioned first resistance element R1. Further, as a result of the second constant current I1 flowing through the second resistance element R2, connected between the operating power-supply line and the drain D of the second enhancement-type n-channel MOS transistor M5, it is possible to generate the reference output voltage slightly lower than the operating-power-supply-line voltage Vdd, such as:

$$(\text{operating-power-supply-line voltage } Vdd)-0.1\ (V)$$

A second embodiment of the present invention will now be described.

Figure 3:
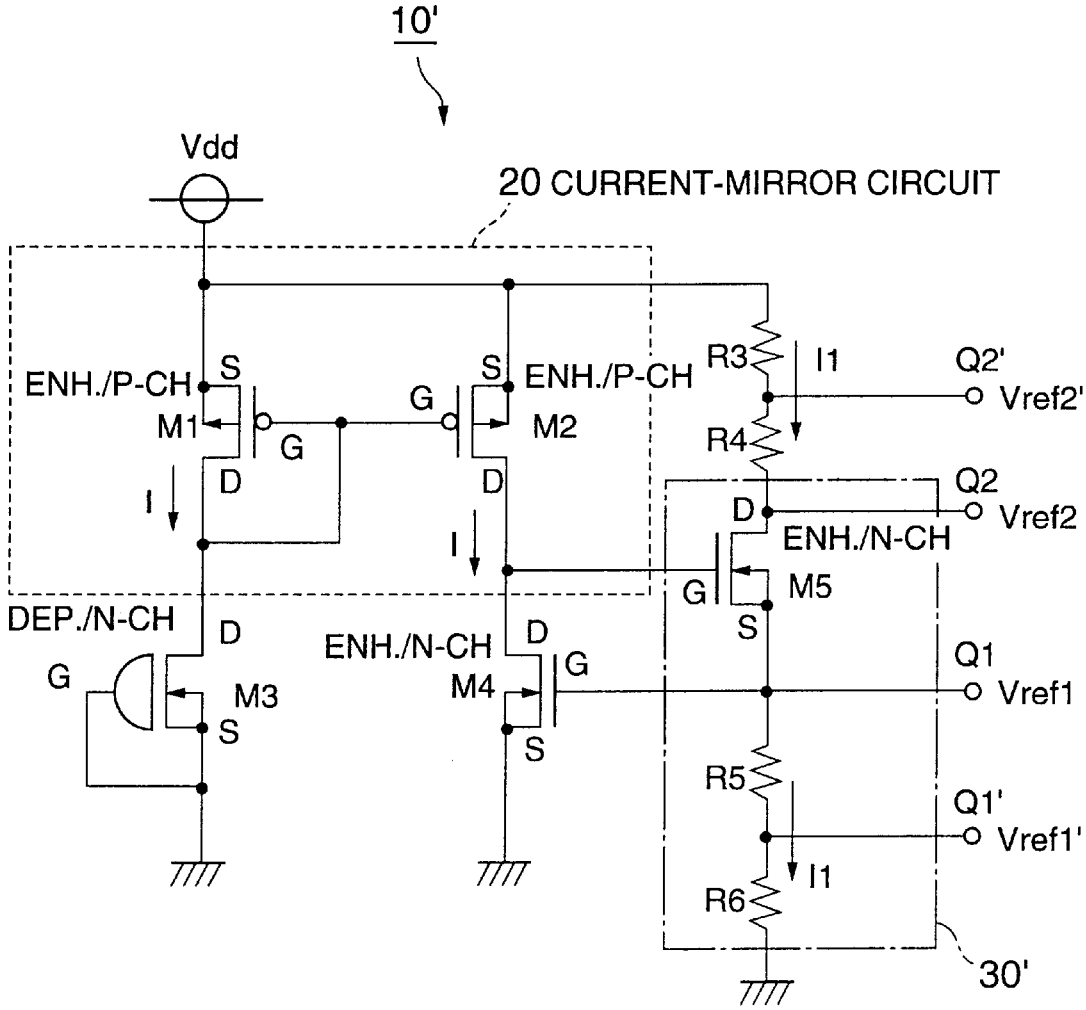
FIG. 3 is a circuit diagram for illustrating a second embodiment of a reference-voltage generating circuit according to the present invention.

FIG. 3 is a circuit diagram illustrating the second embodiment of a reference-voltage generating circuit according to the present invention. The same reference numerals are given to parts the same as those already described in the description of the first embodiment, and duplicate description therefor is omitted.

In a reference-voltage generating circuit 10' in the second embodiment, resistance elements R5 and R6 are used instead of the first resistance element R1 in the FIG. 2, and a third reference voltage $V_{ref1}'$ is provided from the connection point between the resistance elements R5 and R6.

Also, resistance elements R3 and R4 are used instead of the first resistance element R2 in the FIG. 2, and a fourth reference voltage $V_{ref2}'$ is provided from the connection point between the resistance elements R3 and R4.

In consideration of being integrated in an IC together with the devices formed from polycrystal silicon, each of the resistance elements R3, R4, R5 and R6 is formed using the same polycrystal silicon as that of the devices, at the same time, in the process in which the devices are formed.

Because each of the resistance elements R3, R4, R5 and R6 is formed using the same polycrystal silicon, at the same time, in the process in which the devices are formed, it is possible to make the temperature coefficients thereof to be identical to each other. Further, it is possible to perform trimming on each of the resistance elements R3, R4, R5 and R6.

Thus, as a result of the series circuit of the two resistance elements being used instead of each resistance element shown in FIG. 2, it is possible to provide desired constant voltages externally.

Further, the present invention is not limited to the above-described embodiments, and variations and modifications may be made without departing from the scope of the present invention.

The present invention is based on Japanese priority application No. 10-285129, filed on Oct. 7, 1998, the entire contents of which are hereby incorporated by reference.

What is claimed is:

1. A reference-voltage generating circuit, comprising:

a depletion-type n-channel MOS transistor, the gate of said depletion-type n-channel MOS transistor being connected to its source and the bias of said depletion-type n-channel MOS transistor being set to such a condition that said depletion-type n-channel MOS transistor operates in the saturation region so as to act as a constant-current source and generate a first constant current;

a first enhancement-type p-channel MOS transistor, the gate and drain of said first enhancement-type p-channel MOS transistor being connected to one another, said first enhancement-type p-channel MOS transistor being connected between a power-supply line and said depletion-type n-channel MOS transistor;

a second enhancement-type p-channel MOS transistor, connected to said power-supply line to which said first enhancement-type p-channel MOS transistor is also connected, constituting a current-mirror circuit together with said first enhancement-type p-channel MOS transistor and mirroring said first constant current;

a first enhancement-type n-channel MOS transistor, connected between the drain of said second enhancement-type p-channel MOS transistor and ground;

a first resistance element, connected between the gate of said first enhancement-type n-channel MOS transistor and the ground;

a second enhancement-type n-channel MOS transistor, constituting a source-follower circuit together with said first resistance element, and controlling generation of a second constant current in said first resistance element in accordance with activation of said first enhancement-type n-channel MOS transistor;

a first reference-voltage output terminal, connected to the connection point between said first resistance element and the source of said second enhancement-type n-channel MOS transistor, for outputting a first reference voltage;

a second resistance element, connected between said power-supply line and the drain of said second enhancement-type n-channel MOS transistor; and a second reference-voltage output terminal, connected to the connection point between said second resistance element and the drain of said second enhancement-type n-channel MOS transistor, for outputting a second reference voltage.

2. The reference-voltage generating circuit as claimed in claim 1, wherein said first and second resistance elements have the same temperature coefficient, and each of said first and second resistance elements comprises a resistor at least at a portion thereof, the resistance value of which resistor can be set to a desired value through trimming.

3. The reference-voltage generating circuit as claimed in claim 1, wherein the gate dimensions of said depletion-type n-channel MOS transistor and the gate dimensions of said first enhancement-type n-channel MOS transistor are set so that said first reference voltage is equal to the sum of the threshold voltage of said depletion-type n-channel MOS transistor and the threshold voltage of said first enhancement-type n-channel MOS transistor.

4. The reference-voltage generating circuit as claimed in claim 1, wherein:

said first resistance element comprises a series circuit of a third resistance element and a fourth resistance element; and said second resistance element comprises a series circuit of a fifth resistance element and a sixth resistance element, said reference-voltage generating circuit further comprising:

a third reference-voltage output terminal, connected to the connection point between said third resistance element and said fourth resistance element, for outputting a third reference voltage; and a fourth reference-voltage output terminal, connected to the connection point between said fifth resistance element and said sixth resistance element, for outputting a fourth reference voltage.

5. A reference-voltage generating circuit, comprising:

a depletion-type n-channel MOS transistor, the gate of said depletion-type n-channel MOS transistor being connected to its source and the bias of said depletion-type n-channel MOS transistor being set to such a condition that said depletion-type n-channel MOS transistor operates in the saturation region so as to generate a first constant current;

a current-mirror circuit, connected to said depletion-type n-channel MOS transistor, and mirroring the first constant current;

a first enhancement-type n-channel MOS transistor, generating a first constant voltage which depends on the first constant current, when receiving the first constant current mirrored by said current-mirror circuit and being activated, the first constant voltage being outputted as a first reference voltage;

a first resistance element, connected between said first enhancement-type n-channel MOS transistor and ground;

a second enhancement-type n-channel MOS transistor, connected to said first enhancement-type n-channel MOS transistor and said first resistance element, and controlling generation of a second constant current in said first resistance element in accordance with activation of said first enhancement-type n-channel MOS transistor; and a second resistance element, connected between a power-supply line and said second enhancement-type n-channel MOS transistor, and generating a second constant voltage which depends on the second constant current, a voltage at the point between said second resistance element and said second enhancement-type n-channel MOS transistor being outputted as a second reference voltage.

6. The reference-voltage generating circuit as claimed in claim 5, wherein:

said first resistance element comprises a series circuit of a third resistance element and a fourth resistance element, the voltage at the connection point between said third resistance element and said fourth resistance element being outputted as a third reference voltage; and said second resistance element comprises a series circuit of a fifth resistance element and a sixth resistance element, the voltage at the connection point between said fifth resistance element and said sixth resistance element being outputted as a fourth reference voltage.

* * * * *